US010634416B2

(12) United States Patent
Fähnle et al.

(10) Patent No.: US 10,634,416 B2
(45) Date of Patent: Apr. 28, 2020

(54) DOMESTIC REFRIGERATION DEVICE COMPRISING A MACHINE CHAMBER HAVING A CARRIER SHELL, ON WHICH CARRIER SHELL A FURTHER PART IS RETAINED

(71) Applicant: BSH HAUSGERÄTE GMBH, München (DE)

(72) Inventors: Elmar Fähnle, Elchingen (DE); Michael Krapp, Nattheim (DE)

(73) Assignee: BSH Hausgeräte GmbH, Munich (DE)

( * ) Notice: Subject to any disclaimer, the term of this patent is extended or adjusted under 35 U.S.C. 154(b) by 147 days.

(21) Appl. No.: 15/100,779

(22) PCT Filed: Dec. 4, 2014

(86) PCT No.: PCT/EP2014/076595
§ 371 (c)(1),
(2) Date: Jun. 1, 2016

(87) PCT Pub. No.: WO2015/086430
PCT Pub. Date: Jun. 18, 2015

(65) Prior Publication Data

US 2016/0305703 A1 Oct. 20, 2016

(30) Foreign Application Priority Data

Dec. 11, 2013 (DE) ..... 10 2013 225 649

(51) Int. Cl.
*F25D 23/00* (2006.01)
*F25D 11/02* (2006.01)
(Continued)

(52) U.S. Cl.
CPC ..... *F25D 23/006* (2013.01); *F25D 11/02* (2013.01); *F25D 21/14* (2013.01); *F25D 29/005* (2013.01); *F25D 2321/1411* (2013.01)

(58) Field of Classification Search
None
See application file for complete search history.

(56) References Cited

U.S. PATENT DOCUMENTS 3,727,866 A * 4/1973 Drake ..... F25D 23/006 248/664
4,539,737 A * 9/1985 Kerpers ..... F25D 23/006 248/671

(Continued)

FOREIGN PATENT DOCUMENTS

CN 202158716 U 3/2012
CN 202267303 U 6/2012

(Continued)

OTHER PUBLICATIONS

Machine Translation, DE 10 2012 208984 A1.*

(Continued)

*Primary Examiner* — Jonathan Bradford
(74) *Attorney, Agent, or Firm* — Nixon & Vanderhye P.C.

(57) ABSTRACT

The invention relates to a domestic refrigeration device (1), comprising a housing (2), in which an inner container is arranged, which inner container bounds an interior (3, 4) for accommodating foods, and comprising a machine chamber (12) separated from the interior (3, 4), in which machine chamber at least components (6 to 11) of a refrigeration circuit of the domestic refrigeration device (1) are arranged, wherein a carrier shell (11) is arranged in the machine chamber (12), on which carrier shell at least one further part (6, 43, 44, 45, 46, 47, 48) is retained in such a way that the at least one further part is connected by at least one snap connection (49) and/or at least one plug-in connection (50, 53) and/or a locking connection (59) without any additional fastening elements.

23 Claims, 13 Drawing Sheets

(51) Int. Cl.
*F25D 21/14* (2006.01)
*F25D 29/00* (2006.01)

(56) References Cited

U.S. PATENT DOCUMENTS

| | | | | |
|---|---|---|---|---|
| 5,040,953 | A * | 8/1991 | Tinsler | F16F 1/377 248/632 |
| 5,953,929 | A * | 9/1999 | Bauman | F25D 19/00 62/237 |
| 6,363,736 | B1 * | 4/2002 | Kunkel | F25D 21/14 248/247 |
| 2009/0211285 | A1 * | 8/2009 | Picker | F25D 23/006 62/259.1 |

FOREIGN PATENT DOCUMENTS

| | | |
|---|---|---|
| DE | 10 2012 208984 | 12/2013 |
| EP | 1 003 004 | 5/2000 |
| EP | 2 292 993 | 3/2011 |
| EP | 2 669 610 A2 | 12/2013 |
| JP | 2004-251608 | 9/2001 |
| JP | 2012-137258 | 7/2012 |
| WO | WO 2013/141551 A1 | 9/2013 |
| WO | WO 2013/186113 A1 | 12/2013 |

OTHER PUBLICATIONS

International Search Report and Written Opinion of the ISA for PCT/EP2014/076595, dated Feb. 27, 2015, 11 pages.
Text of First Office Action issued in related Chinese Application No. 2014800643926 dated Jun. 21, 2017, 5 pages.

* cited by examiner

DOMESTIC REFRIGERATION DEVICE COMPRISING A MACHINE CHAMBER HAVING A CARRIER SHELL, ON WHICH CARRIER SHELL A FURTHER PART IS RETAINED

This application is the U.S. national phase of International Application No. PCT/EP2014/076595 filed 4 Dec. 2014, which designated the U.S. and claims priority to DE Patent Application No. 10 2013 225 649.3 filed 11 Dec. 2013, the entire contents of each of which are hereby incorporated by reference.

The invention relates to a domestic refrigeration appliance with a housing, in which an inner container which delimits an inner chamber for holding food is arranged. The domestic refrigeration appliance also comprises a machine chamber, which is separate from the inner chamber and in which components of a refrigeration circuit of the domestic refrigeration appliance are arranged.

A refrigeration circuit is provided in a domestic refrigeration appliance, for example a refrigerator, a freezer or a combined refrigerator/freezer. It generally comprises a refrigerant compressor, which is connected to a condenser, the refrigerant compressor being arranged in a machine chamber. The machine chamber here is generally configured in a lower rear region of the domestic refrigeration appliance.

For evaporation outside the chilling region of the domestic refrigeration appliance it is known to collect the thawed water and utilize the waste heat from the compressor present to evaporate it. To this end the thawed water is collected in a collector arranged above the compressor, said collector also being arranged in the machine chamber. The waste heat from the refrigerant compressor heats the thawed water, thereby accelerating evaporation.

Such a configuration is known from DE 10 2011 006 606 A1. Provision is also made there for a collection tray arranged in an upper region of the refrigerant compressor to have a defined overflow for holding and evaporating thawed water. Water overflowing from the collection tray is then conducted away by this into an additional tray positioned below the refrigerant compressor, thus allowing a greater volume to be collected.

Arrangements with a compressor and an evaporation tray are also known from DE 10 2008 041 558 A1 and DE 20 2006 005 552 U1. Only one tray is provided at the respective height level in each of the known embodiments.

Electric cables provided to control and supply energy to corresponding components, for example also the refrigerant compressor and other parts, are also required in the arrangements.

It is the object of the present invention to simplify the incorporation of components in the machine chamber in respect of assembly outlay, while still ensuring reliable and secure retention.

This object is achieved by a domestic refrigeration appliance which has the features according to claim 1.

An inventive domestic refrigeration appliance comprises a housing, in which an inner container is arranged. The inner container delimits an inner chamber for holding food. The domestic refrigeration appliance also comprises a machine chamber, which is separate from the inner chamber and in which at least components of a refrigeration circuit of the domestic refrigeration appliance are arranged. One important concept of the invention is that a carrier tray is arranged in the machine chamber, on which carrier tray at least one further part is held in a connecting manner by at least one snap connection and/or at least one plug-in connection and/or at least one locking connection, with the connecting retention here also being configured without additional fastening elements. This produces a configuration, in which the fastening of a further part on such a carrier rail is configured by one or more snap connections and/or by one or more plug-in connections and/or by one or more locking connections, but with no further additional separate fastening elements then also being required and present. Fastening is therefore effected in each instance in particular only by way of at least one snap connection and/or only at least by way of a plug-in connection and/or by way of only at least one locking connection and also without further additional separate fastening elements.

This significantly reduces assembly outlay and therefore also reduces the number of parts. Fitting and dismantling can take place more quickly while still achieving and allowing at least the same mechanical retention of the part on the carrier tray.

Provision is preferably made for the carrier tray to have a base in which at least one locking mount is configured for a locking connection. Such a locking mount integrated in the base allows fast and assembly-friendly fastening of the further part. The resulting force of the weight of the further part then maintains the locking connection produced in a positively supporting manner.

Provision is preferably made for the carrier tray to have channels that are C-shaped in cross section on upper edge faces of side walls, with gaps for plug-in connections configured in said channels. These side walls are in particular longitudinal side walls. Such a specific shaping of upper edge faces makes the carrier tray extremely stable and also highly torsion-resistant. As a result it serves particularly preferably for the purpose of mechanical coupling with a further part at said points. Because gaps are configured in said channels in practice, corresponding cover elements can extend therein and are thus also retained in a permanently stable manner. The plug-in connection is particularly advantageous precisely at such a locationally specific point and therefore in the upper region of the carrier tray on such a specific edge face profile. This improves access for a fitter and also achieves lateral fixing action. Gaps are therefore preferably slits in said longitudinal side walls, in which plug-in elements of the further part can be inserted preferably with an orientation perpendicular to a longitudinal axis of the carrier tray. This allows both lateral securing and also similarly advantageous axial securing perpendicular thereto and thus securing in the direction of the longitudinal axis of the carrier tray.

Provision is preferably made for the part to have a connection to the carrier tray at two points at least. This further favors mechanically stable retention and positional fixing on the carrier tray. At least two separate mechanical connections can be provided here on upper edge faces, in particular opposing parallel upper edge faces in relation to the longitudinal axis of the carrier tray. Also a mechanical coupling of the further part to the carrier tray can be provided on both such an upper edge face and the base of the carrier tray. This allows a wide range of connection designs to be achieved, so that differently dimensioned and configured further parts can be locked and anchored in the carrier tray in the best possible manner specifically for their size and/or weight and/or shape.

Provision is preferably made for the further part to have a connection to the carrier tray at two points at least, the advantages that can thus be achieved having been set out above.

Provision is preferably made for a first part to be fastened to a base of the carrier tray with a first connection type, in particular a locking connection, and to a longitudinal side wall of the carrier tray with a second connection type, in particular a plug-in connection. This is an advantageous embodiment, particularly when the carrier tray is configured smaller in a direction perpendicular to the longitudinal axis and thus in a direction extending between the upper edge faces than such a distance between the two edge faces. Provision is thus made in particular for the first part, when connected to the carrier tray, to have a dimension in a direction perpendicular to a longitudinal axis of the carrier tray that is smaller than a distance between two longitudinal faces in the carrier tray. A further part thus dimensioned is therefore also fastened more securely to the carrier tray.

Provision is preferably made for a first part to be an operating capacitor housing which therefore holds a capacitor of the refrigeration circuit of the domestic refrigeration appliance. The housing therefore represents a unit for holding said capacitor.

Provision is preferably made for a second part to be fastened to a first longitudinal side wall of the carrier tray with a first connection type, which is preferably a snap connection, and to be connected to a second longitudinal side wall of the carrier tray with a second connection type, which is preferably a plug-in connection. The snap connection and the plug-in connection are different connection types. Provision is made in particular here for a snap connection to be defined in that a snap element is arranged in a movable manner on a further part that can be positioned on the carrier tray, in particular in such a manner that it can be rotated and pivoted in relation thereto about a rotation axis. The completion of such a rotational movement causes it to snap into a snap mount on the carrier tray.

A plug-in connection is defined in particular in that a plug-in element is inserted into a plug-in mount but is not locked or snapped into it, retention simply being brought about by such insertion and plugging in.

In contrast a locking connection is defined in that when the locking element and a locking mount are inserted into one another between the carrier tray and the further part, retention is produced by any kind of engagement and/or hooking behind.

Provision is preferably made for a part to be fastened to the carrier tray to be connected to the carrier tray by means of a snap connection, it having a pivotable snap element which engages in a channel of C-shaped cross section configured on an upper edge face of the longitudinal side wall of the carrier tray, thus snapping into the hollow space formed by the C shape. This anchors the snap element particularly effectively, as the C shape also allows said channel to have a certain flexibility for the purpose of deformation, thereby also allowing a certain form-fit engagement of the snap element in said C shape, which is then formed in such a manner in cross section that the snap element is also enclosed by said C shape of the channel in the manner of a clamp in a region engaging in the channel.

Provision is preferably made for a snap element to have at least one integral plug-in element for a plug-in connection. Such an embodiment then offers both a snap connection and a plug-in connection in an integral dual form, thus allowing particularly reliable connection and retention for individual parts, it being possible also to establish and release such connection and retention in a very assembly-friendly manner.

Provision is preferably made for a second part to be a water stop unit or a collection and evaporation tray for thawed water or an electronic unit or a compressor of a refrigeration circuit of the domestic refrigeration appliance.

The proposed design of the mechanical connection of further parts to such a carrier tray in the machine chamber of the domestic refrigeration appliance allows both very large parts and also smaller parts to be retained therein in a reliable and positionally secure manner by means of a simple and fast fitting operation.

For large parts a 180° curvature of the carrier tray is preferably used front and back, being configured in particular on the upper edge faces and being formed by the preferably C shape. The hollow space in said curvature preferably serves as an insertion option for feet of the parts housings to be incorporated. The position is thus predefined vertically and horizontally and also in a forward and rearward direction. Essentially recesses are arranged with gaps on said C-shaped edge faces of the carrier tray, allowing perpendicular ribs on the feet of the parts to be fitted to enter therein. The incorporation position is thus defined practically during assembly in a self-centering manner and the correct orientation of the part to be fitted in the carrier tray is automatically achieved, as provision is also preferably made for the possible connections to be configured in such a manner that a quite specific position can be provided in each instance for a part to be fitted so that just one specific fitting operation is possible here too. Incorrect orientation or arrangement of a part in an incorrect position on the carrier tray is prevented as a result so that the possible connections also allow a sort of assembly coding.

Such recesses or gaps are preferably positioned in such a manner that a number of parts can be fitted depending on use. In one advantageous embodiment a front foot of a part is preferably supported in a movable manner and above a rotation axis in the receiving housing, with a snap element, as defined above, being configured in particular as a result.

In the case of an electronic housing or an electronic unit to be fitted as a part on the carrier tray or an evaporation tray, a snap connection is provided for such a foot in its assembly position.

Provision is also made for the housing of said parts then to be fitted by spreading the front and rear feet out between the front and rear 180° curvature or C shape of the carrier tray.

The preferred type of option for form fit and force fit depends on the requirements of the configurations. Provision can also be made in the case of an electronic unit and/or an evaporation tray for further securing in that a snap connection has to be disassembled using a tool, for example a screwdriver for unlocking purposes. Provision can be made in the case of a water stop unit for a connection also to be released with such a screwdriver for disassembly.

In the case of small parts, for example an operating capacitor as cited by way of example, only one of these specifically shaped edge faces of the carrier tray is used in particular for mechanical coupling. Gaps in the curvature or C-shaped configuration of the upper edge face then also preferably serve here as an insertion option for a lower foot or a plug-in element of the housing to be incorporated. For the rear region of said housing the position is then defined vertically and horizontally in a rearward direction. In the case of a housing foot a perpendicular rib then preferably defines the incorporation position here too by entering the recess in the carrier rail, in particular a locking mount in a base, and fixes the horizontal position to the left and right in relation to the two faces opposite a longitudinal axis of the carrier tray.

A front foot of said housing is preferably embodied as a box-type element in a lead-in chamfer. This makes threading into a counter mount easier and assembly is more user-friendly.

The box projecting through an opening or a locking mount in the carrier tray defines the horizontal incorporation position in the front region of the housing and also provides retention forward and rearward in the direction of the longitudinal axis of the carrier tray. Corresponding retention is then also achieved perpendicular to said longitudinal axis.

A front wall of the box is preferably interrupted and forms a movable snap hook. Together with the box of the front foot resting on the carrier tray, this snap hook or snap element then fixes the vertical position in the front region of the housing.

Provision is preferably made for a snap hook or a snap element of the further part to lock into a second slit-type opening in particular a locking mount integrated in the base, in the carrier tray in the event of tensile load. This prevents the snap connection being released.

Provision is preferably made for lateral support ribs to ensure compensation for manufacturing tolerances in respect of position fixing so that the housing of the part to be incorporated cannot generate vibration noise.

Further features of the invention will emerge from the claims, figures and description of the figures. The features and feature combinations cited above in the description and the features and feature combinations cited below in the description of the figures and/or simply illustrated in the figures can be used not only in the combination specified in each instance but also in other combinations or alone, without departing from the scope of the invention. Embodiments of the invention that are not described and illustrated specifically in the figures but emerge and can be produced from the described embodiments by means of separate feature combinations should therefore also be considered to be included and disclosed.

Exemplary embodiments of the invention are described in more detail below with reference to schematic drawings, in which.

In the figures identical elements or those of identical function are shown with identical reference characters.

Figure 1:
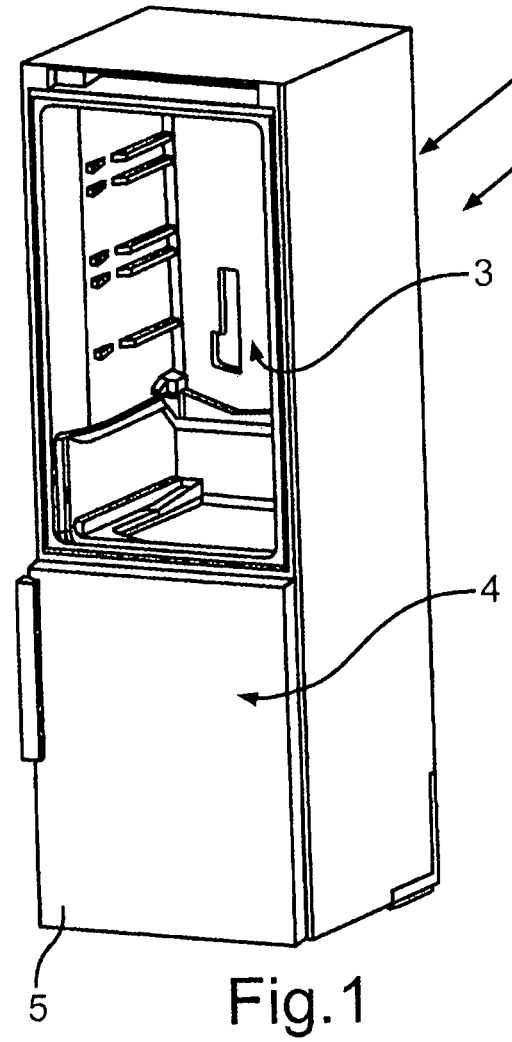
FIG. 1 shows a perspective front view of an exemplary embodiment of an inventive domestic refrigeration appliance.

FIG. 1 shows a perspective front view of a domestic refrigeration appliance 1, which has a housing 2 configured as an outer housing. The housing 2 encloses an inner container, which delimits two different separate inner chambers 3 and 4, the inner chambers 3, 4 being configured to hold food.

By way of example the lower inner chamber 4 is closed by a door 5. The upper inner chamber 3 is shown without such a door to allow a view into it, even though such a door is actually present on the domestic refrigeration appliance 1.

Figure 2:
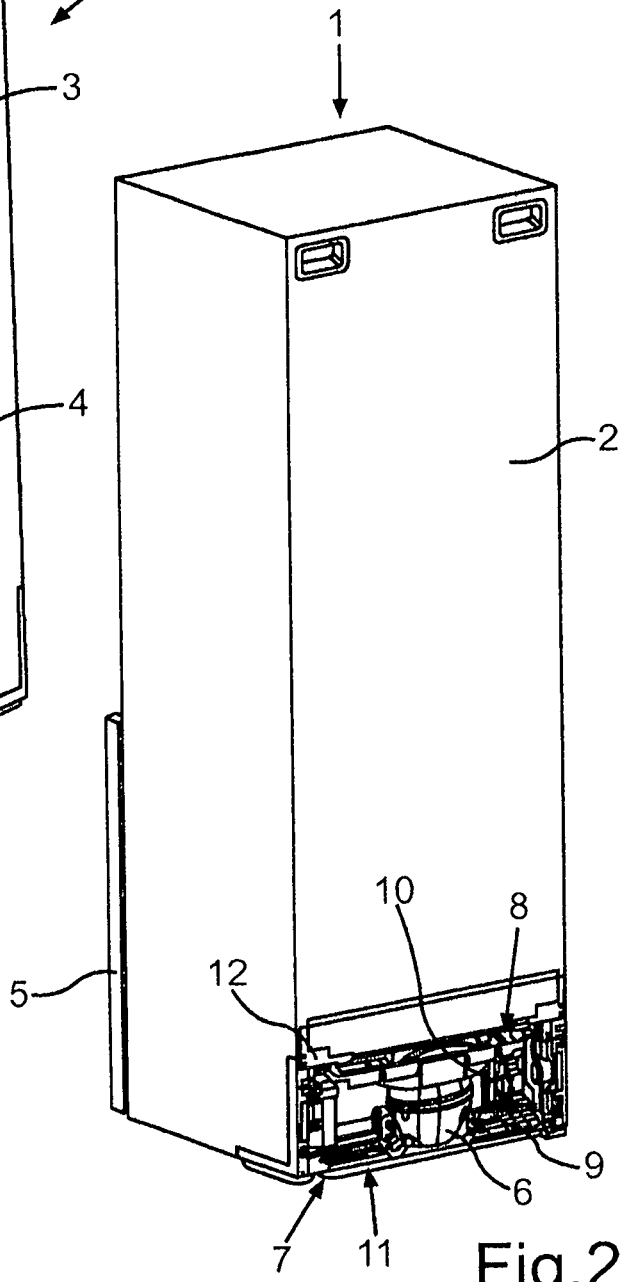
FIG. 2 shows a perspective rear view of the domestic refrigeration appliance according to FIG. 1.

The domestic refrigeration appliance 1 can be a refrigerator or a freezer or a combined refrigerator/freezer. It comprises at least one refrigeration circuit, by means of which corresponding cold temperature control is produced in the inner chambers 3 and 4. The refrigeration circuit comprises a refrigerant compressor 6, as shown in FIG. 2, which shows a perspective view of the domestic refrigeration appliance 1 from the rear. The refrigeration circuit also comprises in particular a condenser and an evaporator. The refrigerant circulates through the circuit.

As shown in FIG. 2, the refrigerant compressor 6 is arranged in a rear lower region of the domestic refrigeration appliance 1. Said region represents a machine chamber 12. It is separated from the inner chambers 3 and 4. The machine chamber 12 is configured to hold components of the refrigeration circuit.

During operation the refrigerant compressor 6 generates waste heat which is used to evaporate thawed water, which is collected, in the domestic refrigeration appliance 1. To this end the domestic refrigeration appliance 1 comprises an apparatus 7, which is configured to hold thawed water and subcomponents of which at least are also arranged in the machine chamber 12. To this end a drip tray 8 of the apparatus 7, which is configured to collect thawed water, is arranged in the machine chamber 12. It is arranged so to speak above the refrigerant compressor 6 so that there is a thermal coupling to evaporate the collected thawed water.

The apparatus 7 also comprises a further collection tray 9 for the thawed water, which is connected to the drip tray 8 by way of a connecting line 10.

The apparatus 7 also comprises a carrier tray 11, which is provided to hold the collection tray 9 and which is also arranged in the machine chamber 12.

The machine chamber 12 is delimited by boundary walls.

Figure 3:
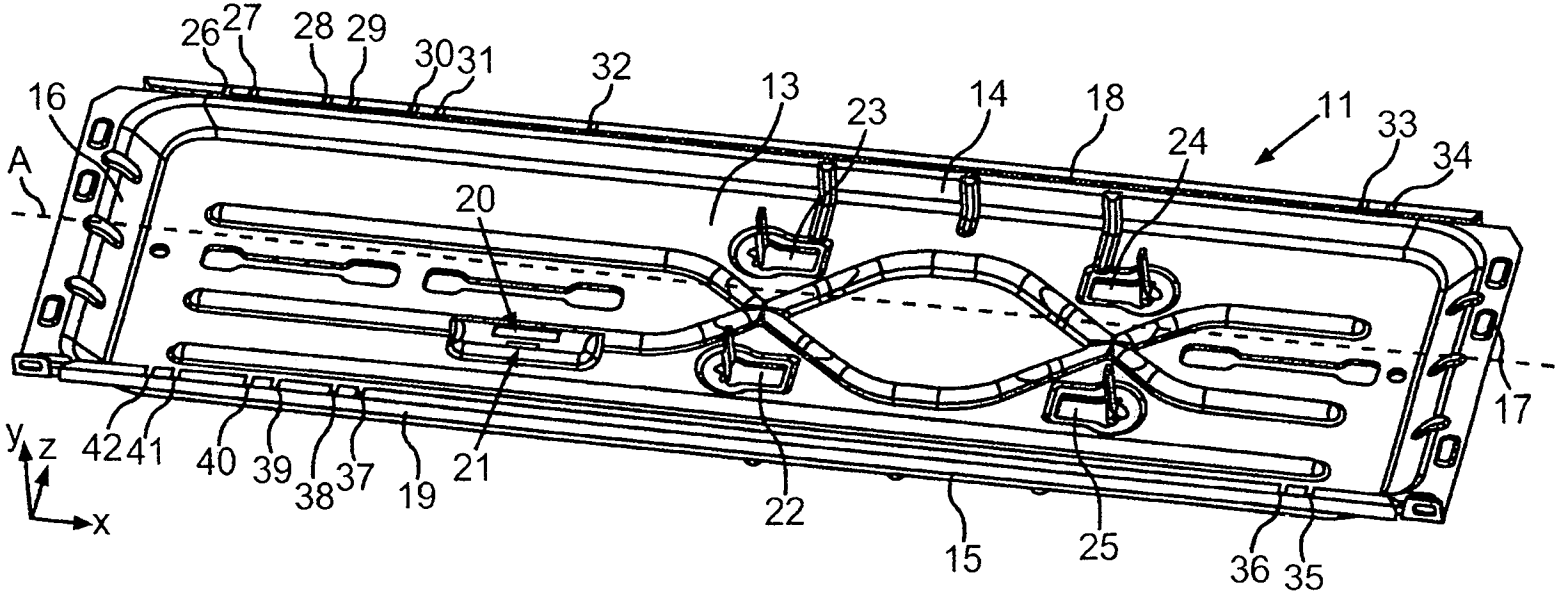
FIG. 3 shows a perspective representation of an exemplary embodiment of a carrier tray in a machine chamber of the domestic refrigeration appliance.

FIG. 3 shows a perspective representation of an exemplary embodiment of a carrier tray 11. It is configured as a single piece in particular from a metallic material and has a longitudinal axis A. The carrier tray 11 has a base 13, around the edges of which side walls 14 and 15 open out in an upright manner, representing longitudinal side walls, which thus extend parallel to the longitudinal axis A, as well as a front wall 16 and a rear wall 17. The longitudinal side walls 14 and 15 have C-shaped channels 18 and 19 on their upper edge faces away from the base 13. The C shape is formed in cross section and thus in a plane perpendicular to the longitudinal axis A. These channels 18 and 19 extend essentially over the entire length of the longitudinal side walls 14 and 15.

Openings 20 and 21 are configured in the base 13 as locking mounts. Further recesses 22, 23, 24 and 25 are also configured, these also being designed as through openings. The openings 22 to 25 are preferably provided for the connection of a further part, configured as a refrigerant compressor 6, which is held in a fixed position on the carrier tray 11. In this embodiment the fastening is in particular at least one snap connection and/or at least one plug-in connection and/or at least one locking connection also without any further additional separate fastening element, so a configuration free from any additional fastening element or without any additional fastening element is achieved here.

Provision is also made for said channels 18 and 19 to have slit-type recesses or gaps 26, 27, 28, 29, 30, 31, 32, 33, 34, 35, 36, 37, 38, 39, 40, 41 and 42. Such gaps 26 to 42 in particular form insertion regions for plug-in elements of a further part to be fastened to the carrier tray 11, providing in particular plug-in connections here.

Figure 4:
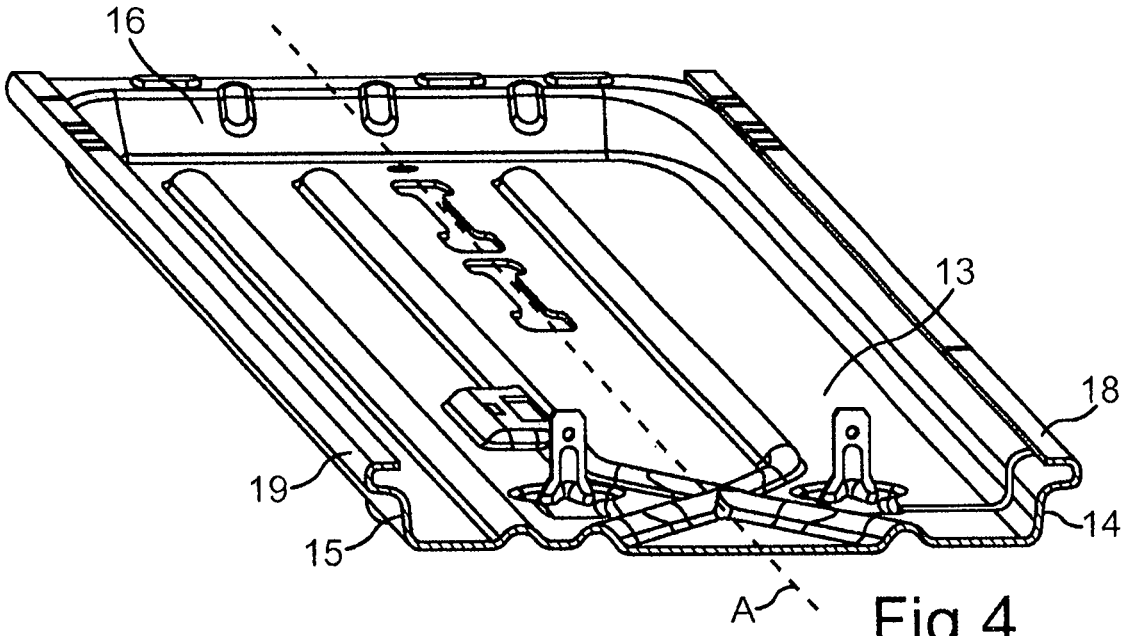
FIG. 4 shows a perspective sectional representation of the carrier tray according to FIG. 3.

The carrier tray 11 is shown in a perspective sectional representation in FIG. 4, with the sectional plane here running perpendicular to the axis A and being characterized by the y-z plane. The C-shaped configuration of the channels 18 and 19 is shown, with the openings of the C shape facing one another.

The C shape is formed by a 180° curvature of the upper configuration of the side walls 14 and 15.

Figure 5:
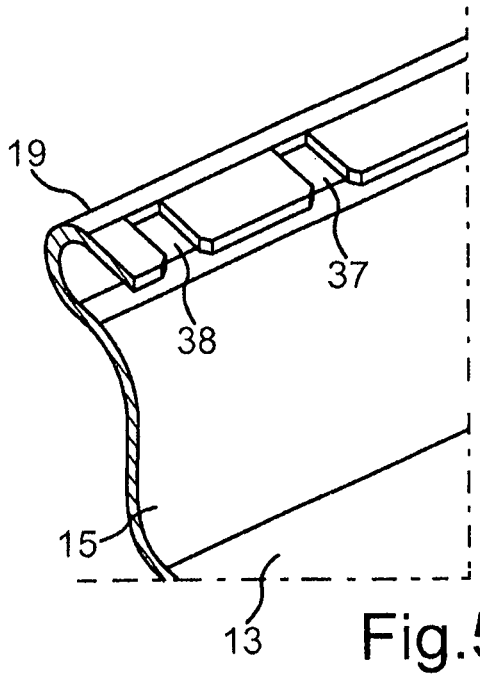
FIG. 5 shows an enlarged representation of a partial sectional representation from FIG. 4.

FIG. 5 shows an enlarged representation of a partial section of the view in FIG. 4, also showing the corresponding recesses in the form of the gaps 37 and 38.

Such options for connecting further parts to the carrier tray 11 without additional separate fastening elements allow very fast but still positionally secure individual fitting of the respective further parts. The locational arrangement of the openings 20 and 21 and 22 to 25 and/or the locational and specifically shaped configurations of the gaps 26 to 42 allow individually shaped parts, which also vary in dimensions, to be fastened thereto. The parts can extend over the entire width (direction perpendicular to the longitudinal axis A) and thus in the z direction between the channels 18 and 19 and can thus be fastened in corresponding gaps 26 to 42 opposite one another by means of plug-in connections. In the case of parts of correspondingly smaller width a similarly provided at least 2-point fastening can be effected on the one hand in at least one gap 26 to 42, on the other hand in an opening 21 to 25.

Figure 6:
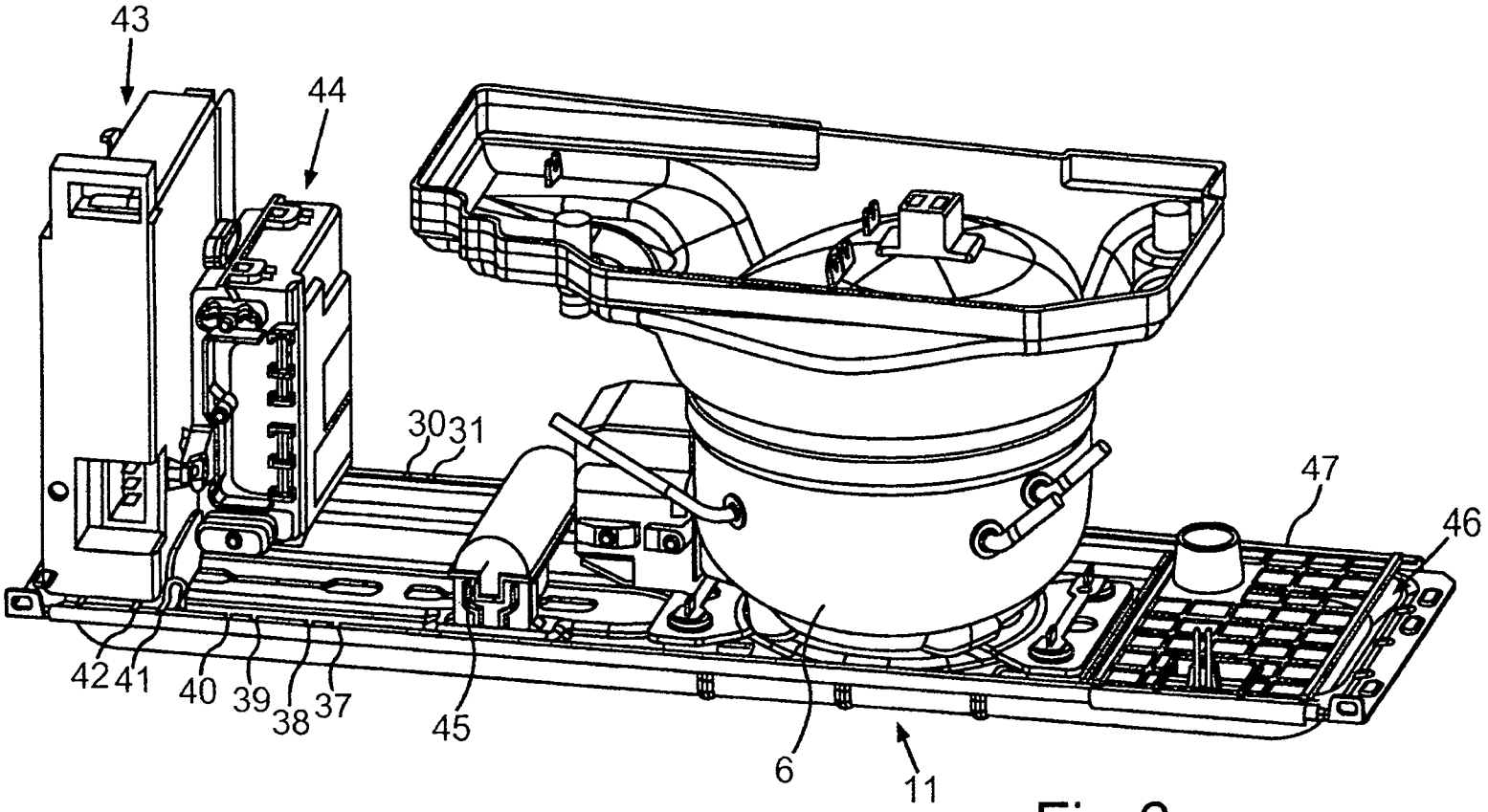
FIG. 6 shows a perspective representation of an exemplary embodiment of the fitting of a carrier tray according to FIG. 3 to FIG. 5 with further parts.

FIG. 6 shows a perspective representation of an example, in which a number of further parts are fastened to the carrier tray 11. These can be electronic units 43 and 44, which are preferably fastened by plug-in connections and/or snap connections to the channels 18 and 19. An operating capacitor housing 45 can also be fastened correspondingly. The refrigerant compressor 6 is fastened as described above. The fastening of a further evaporation tray 46, which can also be the tray 9, is also provided with cover in the form of an evaporation grid 47 arranged above it. A connection to the carrier tray 11 without additional fastening elements is provided in each of these configurations.

Figure 7:
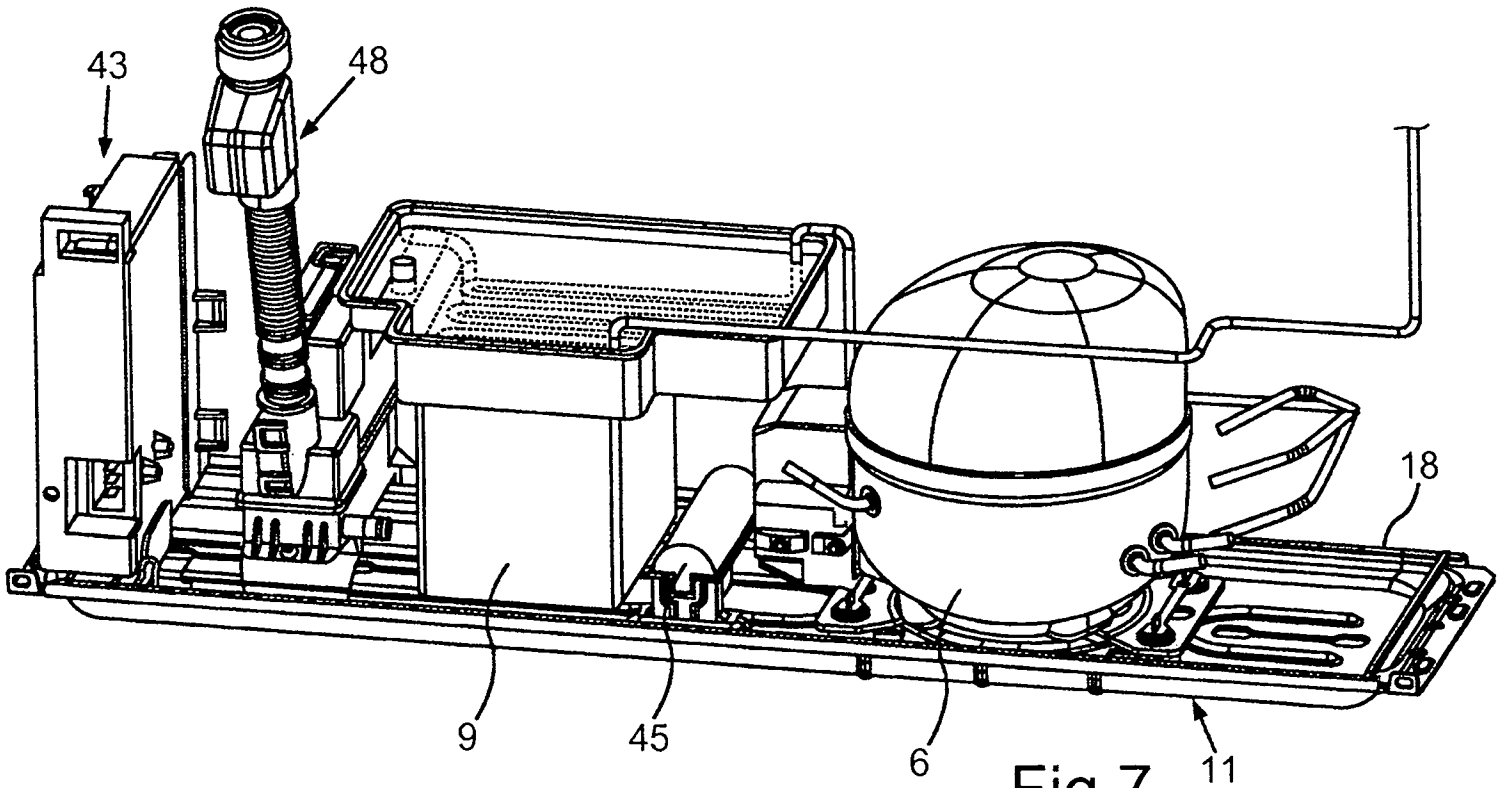
FIG. 7 shows a perspective representation of a further exemplary embodiment of a carrier tray fitted with parts.

FIG. 7 shows a perspective view of a further exemplary embodiment of further parts fitted to the carrier tray 11 in a different manner from FIG. 6. The corresponding fastening of the collection tray 9 to the carrier tray 11 by means of a snap connection and/or a plug-in connection and/or a locking connection is also shown here. The fastening of a water stop unit (aquastop unit) 48 is also shown. It should be noted that the electronic unit 43 and the aquastop unit 48 are fastened in the channels 18 and 19 in particular by way of plug-in connections and/or snap connections. The collection tray 9 in contrast is fastened to the openings 20 and 21 at least by way of a locking connection and can also be connected at least on one side to a channel 18 or 19 by way of an additional plug-in connection.

The operating capacitor housing 45 is correspondingly fastened on just one side to a channel 18 and locked to the base 13 on the other side by way of a locking mount.

Figure 8:
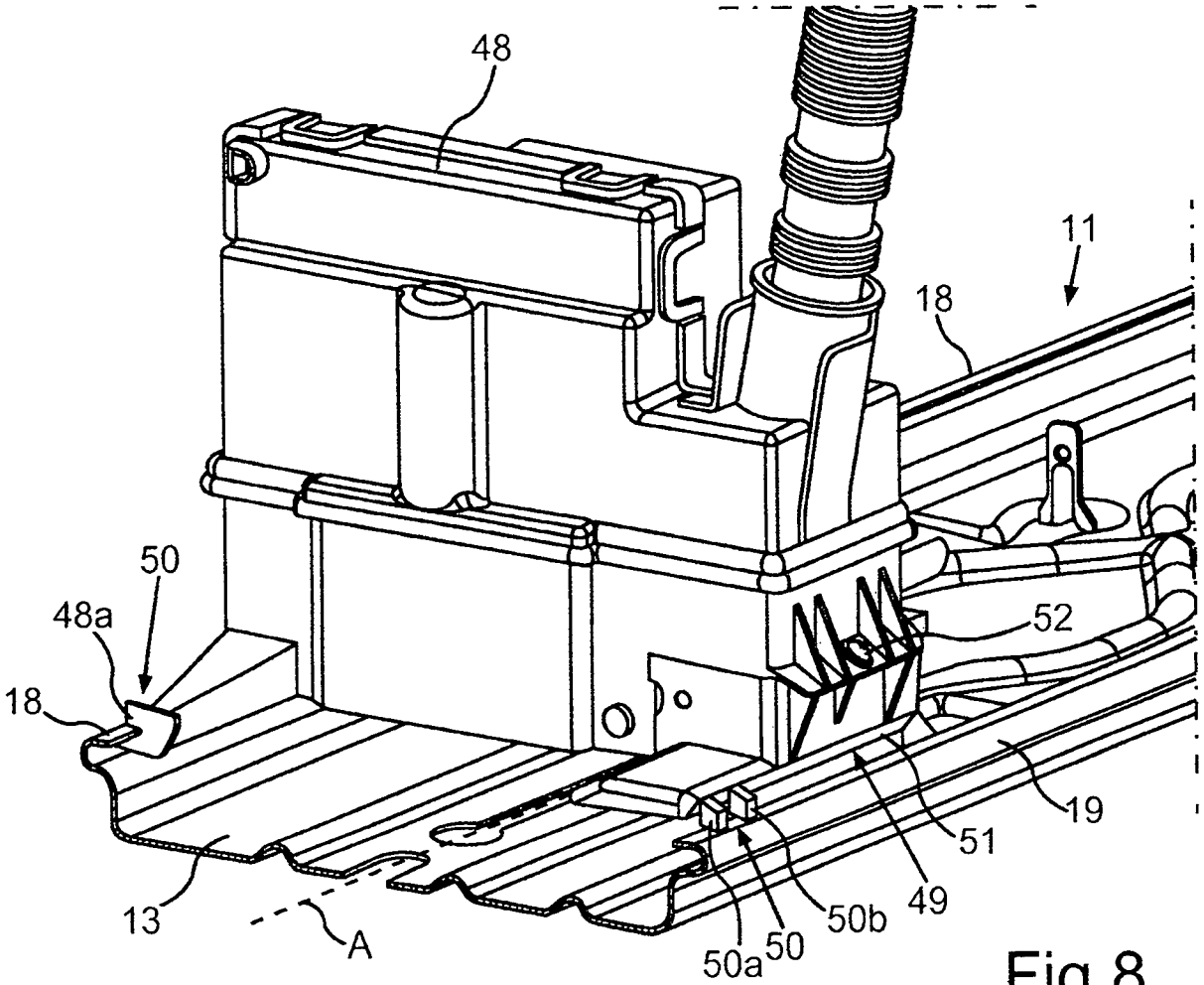
FIG. 8 shows a perspective representation of an exemplary embodiment in which a water stop unit is fastened to a carrier tray.

FIG. 8 shows an enlarged perspective sectional representation of the fastening of the water stop unit 48 to the carrier tray 11. It can be seen here that plug-in elements 48*a* in the form of positioning ribs engage in gaps, in particular the gaps 30 and 31, in the channel 18 and are thus inserted correspondingly. On the opposite side the mechanical coupling of the water stop unit to the channel 19 is brought about on the one hand by a snap connection 49 and on the other hand also by a plug-in connection 50. To this end plug-in elements 50*a* and 50*b*, which are molded on as a single piece, are also provided here in the form of positioning ribs, which in particular engage in or are inserted into the gaps 37 and 38 in the channel 19. The snap connection 49 comprises a rotatable foot with a snap element 51, which can be pivoted about an axis running parallel to the longitudinal axis A. A catch element 52 is also provided, which can be used to secure the snapped position of the snap element 51.

Figure 9:
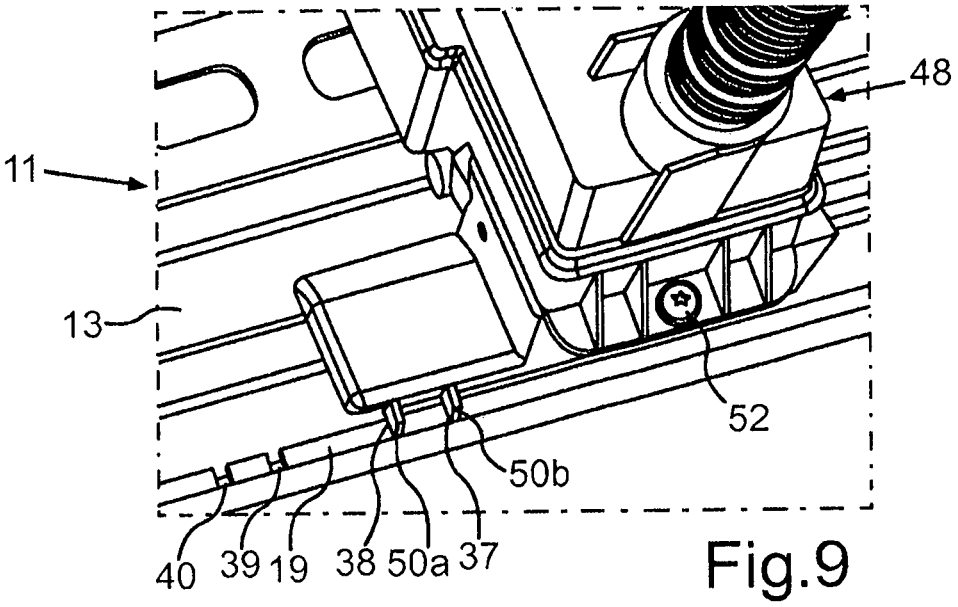
FIG. 9 shows a perspective top view of a partial section of the representation in FIG. 8.

FIG. 9 shows a perspective view from above of the representation in FIG. 8.

Figure 10:
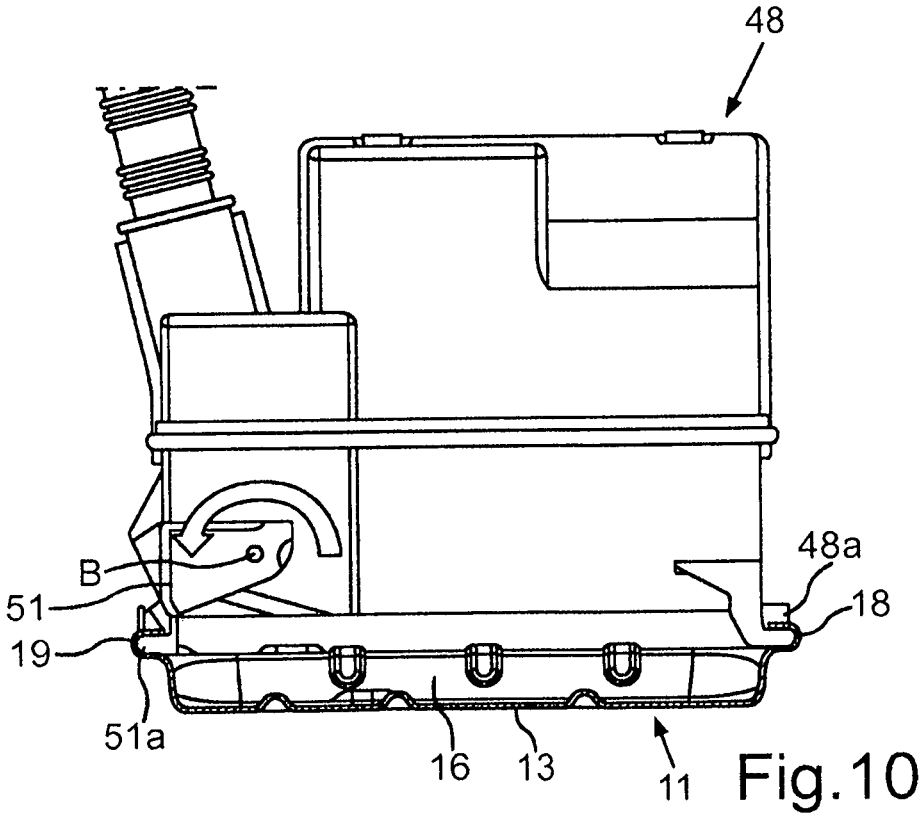
FIG. 10 shows a sectional representation of the representation in FIG. 8.

FIG. 10 shows a view in the direction of the longitudinal axis A of the embodiments in FIG. 8 and FIG. 9. It shows the pivoting of the snap element 51 about an axis B which runs perpendicular to the plane of the figure. The snap element 51 has a hook 51*a*, which engages in the hollow space of the C-shaped channel 19.

Figure 11:
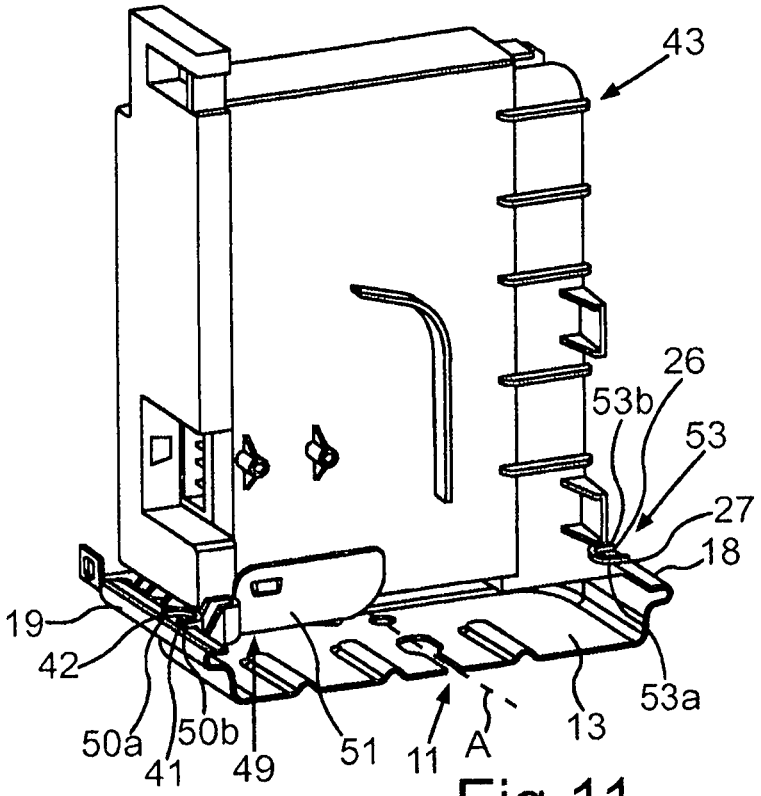
FIG. 11 shows a further perspective sectional representation of a further exemplary embodiment, in which an electronic unit is retained on the carrier tray.

FIG. 11 shows a perspective sectional representation of the fastening of the electronic unit 43 to the opposing channels 18 and 19 of the carrier tray 11. Here too a fastening is provided by way of both a snap connection 49 and a plug-in connection 53, with plug-in elements 53*a* and 53*b* configured again here as positioning ribs being inserted into gaps 28 and 29 in the channel 18. On the opposing side plug-in elements 50*a* and 50*b* are provided, which are integrated in the snap element 51 and again configured as positioning ribs, and these are inserted into the gaps 41 and 42.

Figure 12:
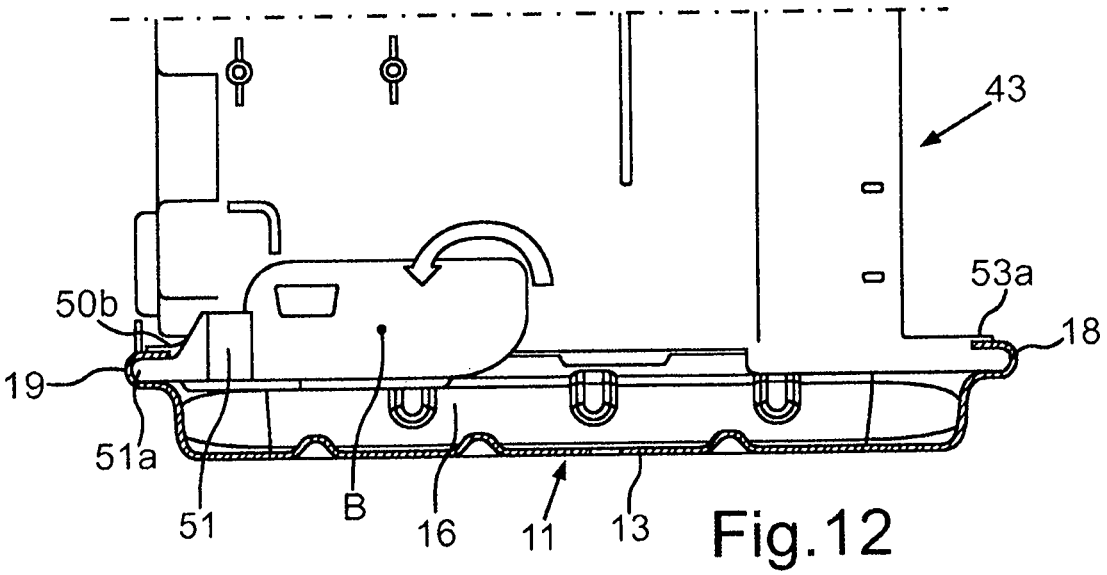
FIG. 12 shows a further perspective of the representation in FIG. 11.

FIG. 12 again shows a view in the direction of the longitudinal axis A of the representation in FIG. 11. As in the representations in FIG. 10 and FIG. 12, the parts fastened to the opposing channels 18 and 19 are arranged at a distance from the base 13 so that they are positioned without contact therewith.

Figure 13:
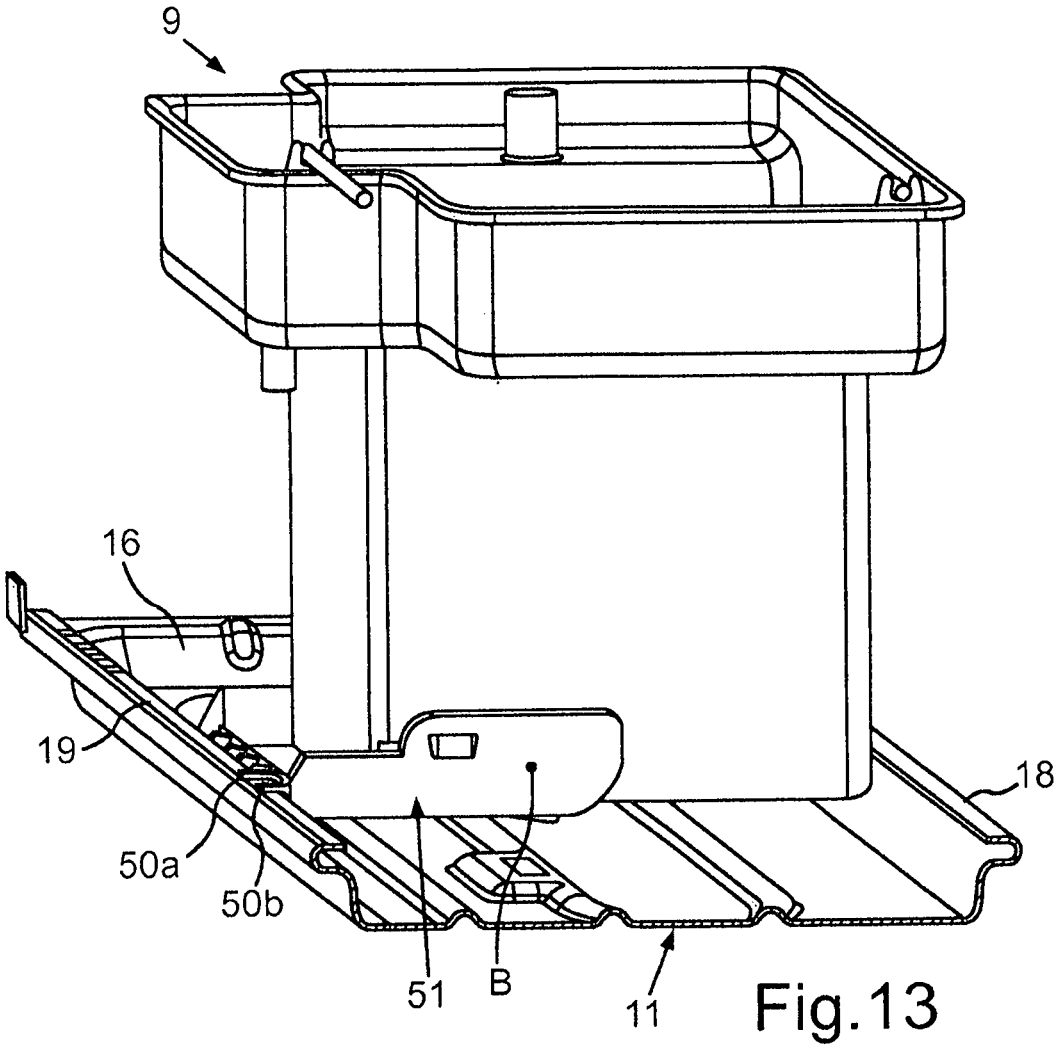
FIG. 13 shows a perspective sectional representation of a further exemplary embodiment, in which an evaporation tray is fastened to the carrier tray.
Figure 14:
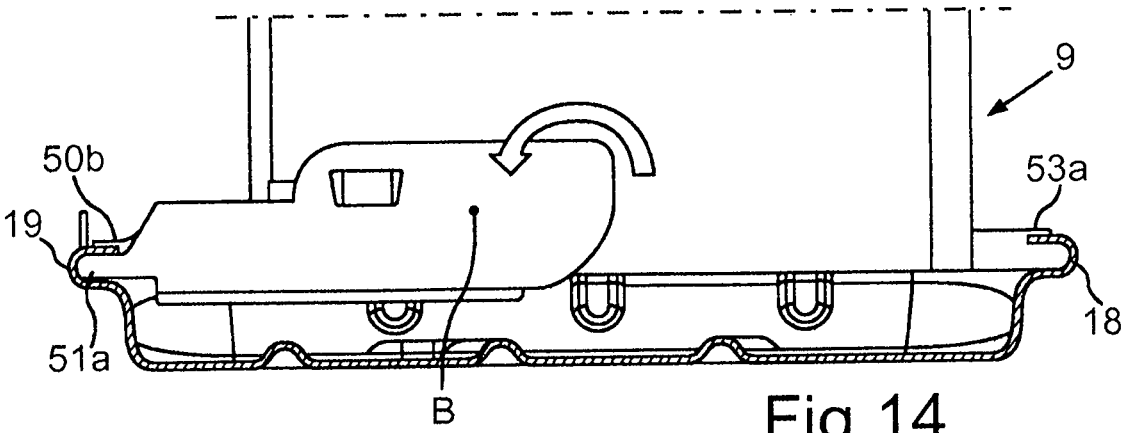
FIG. 14 shows a further perspective of the representation in FIG. 13.

FIG. 13 shows a perspective sectional representation of the fastening of the collection tray 9 to the carrier tray 11, the fastening principle here being the same as that set out in FIGS. 8 to 12 for the water stop unit 48 and the electronic unit 43. Reference should be made to the corresponding descriptions here.

The further parts described above in the form of the collection tray 9, the electronic unit 43 and the water stop unit 48 have the dimensions measured over the entire distance between the channels 18 and 19 in the z direction and therefore perpendicular to the longitudinal axis A.

Figure 16:
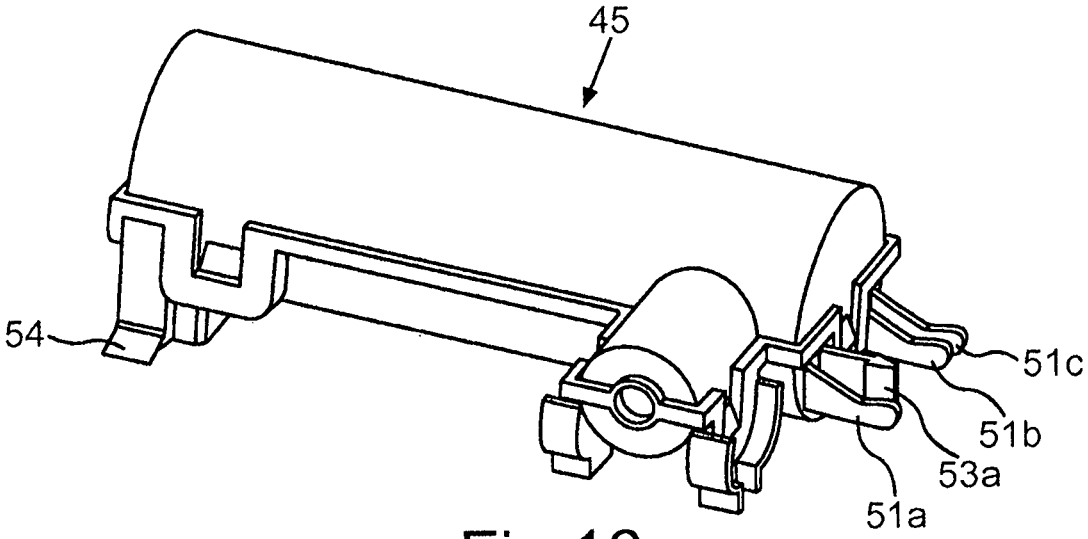
FIG. 16 shows a first perspective of the operating capacitor.

FIG. 16 shows the part of the operating capacitor 45 described above, which is shorter in the z direction than the distance between the channels 18 and 19. Fastening to opposing channels 18 and 19 is therefore not possible.

Figure 17:
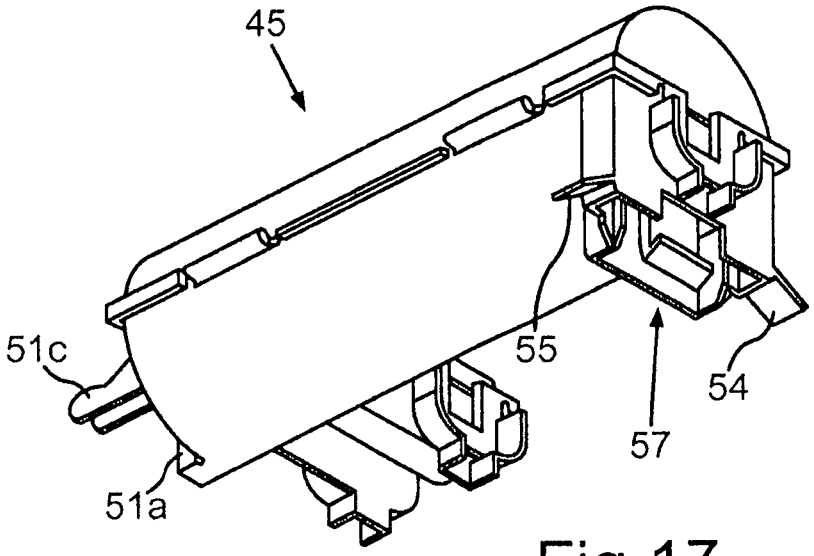
FIG. 17 shows a second perspective of the operating capacitor.
Figure 18:
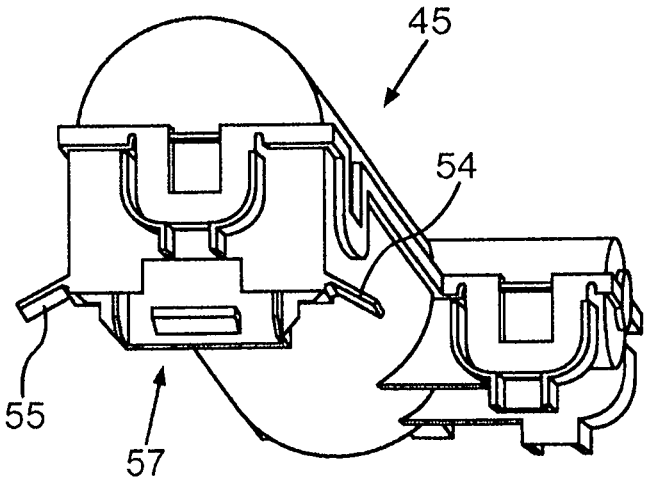
FIG. 18 shows a third perspective of the operating capacitor.

The operating capacitor housing 45 therefore has plug-in elements in the form of positioning ribs at one end, only one plug-in element 53*a* being shown in this exemplary embodiment. Configured adjacent thereto and running parallel thereto are positionally fixed snap elements 51*a*, 51*b* and 51*c*, which engage in the hollow space of the C-shaped channel 18. Tabs forming support ribs 54 and 55 (FIGS. 17 and 18) are also configured on the opposing ends in the manner of wings and project obliquely to the rear. The operating capacitor housing 45 is supported on the base 13 by means of said support ribs 54 and 55, in some instances also engaging in openings 56, the state in which the operating capacitor housing 45 is fastened to the carrier tray 11 also being shown in the perspective sectional representation in FIG. 15. The operating capacitor housing 45 also comprises a box 57 protruding through the carrier tray 11, as shown in FIG. 17. This in particular snap hook locks it to the base 13, with a locking connection thus being configured here between the box 57 and an opening in the form of a locking mount in the base 13. FIGS. 17 and 18 show respective perspective representations of the embodiment of the operating capacitor housing 45 with the respective connection elements.

Figure 19:
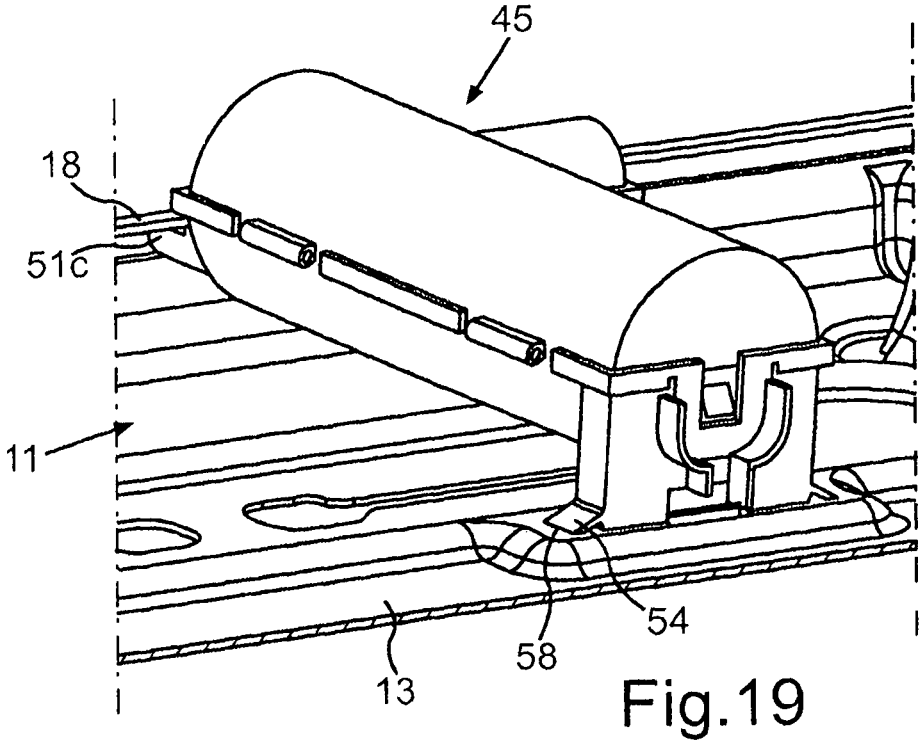
FIG. 19 shows a perspective sectional representation in a different view from the configuration according to FIG. 15.

FIG. 19 shows a perspective sectional representation of the fitted operating capacitor housing 45 on the carrier tray 11. It also shows the connected state of the support rib 54 in the opening 58 in the base 13. The snapped state of the snap element 51*c* in the channel 18 is also shown.

Figure 15:
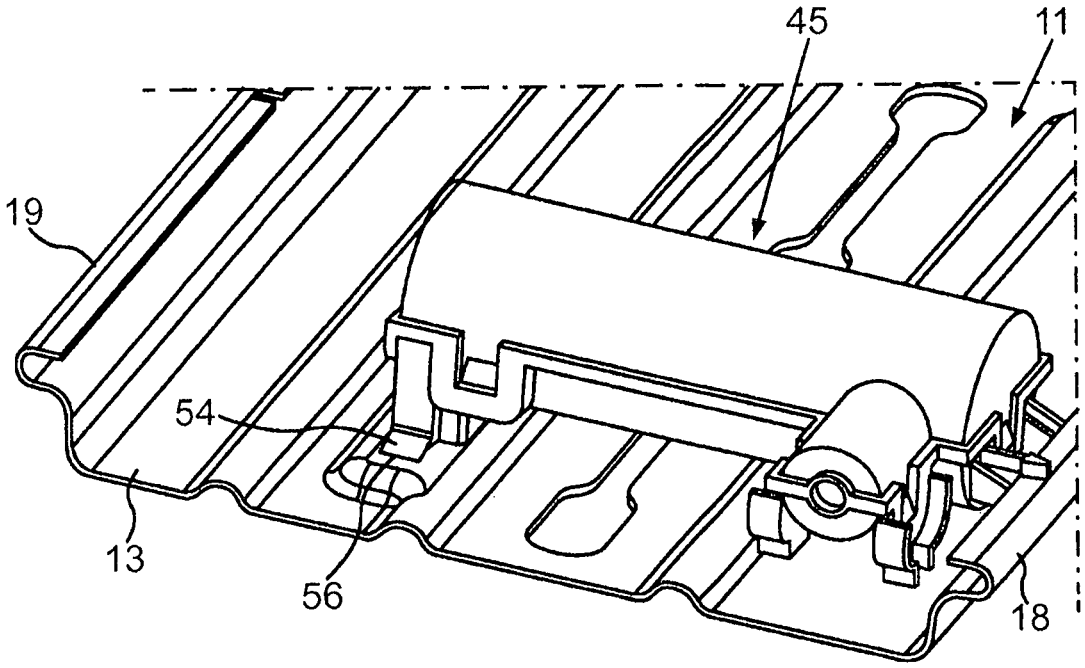
FIG. 15 shows a perspective sectional representation of a further exemplary embodiment, in which an operating capacitor is fastened to the carrier tray.
Figure 20:
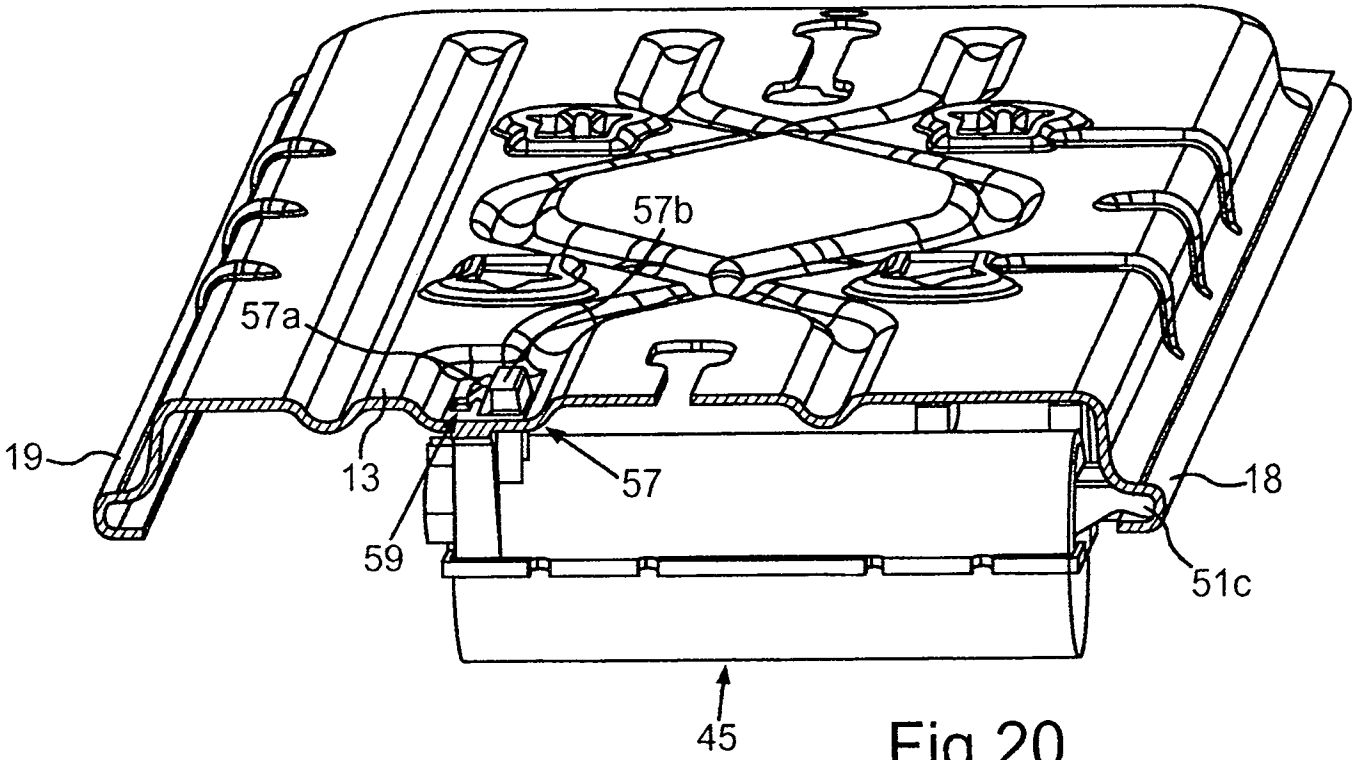
FIG. 20 shows a perspective view of the lower face of the carrier tray according to the embodiment in FIG. 15 and FIG. 19.

FIG. 20 shows a perspective representation from below of the embodiments in FIG. 15 and FIG. 19. The locked state of the box 57 in the base 13 is also shown here. A locking element 57*a* and an element 57*b* engage and lock in the openings 20 and 21 for this purpose.

A locking connection 59 is also configured as a result.

Figure 21:
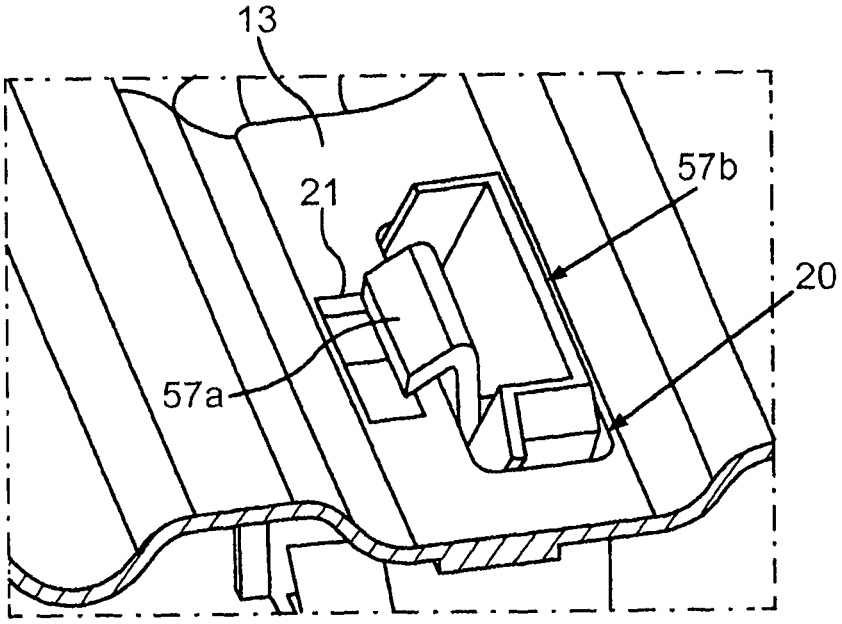
FIG. 21 shows an enlarged representation of a subregion of the view in FIG. 20.

FIG. 21 shows an enlarged representation. In particular the element 57*b* is preferably configured as a simple plug-in element, which does not then lock in the opening 20 but is simply inserted so a plug-in connection with integrated locking connection is configured here, with the locking element 57*a* being correspondingly locked.

LIST OF REFERENCE CHARACTERS

1 Domestic refrigeration appliance
2 Housing
3, 4 Inner chambers
5 Door
6 Refrigerant compressor
7 Apparatus
8 Drip tray
9 Collection tray
10 Connecting line
11 Carrier tray
12 Machine chamber
13 Base
14, 15 Side walls
16 Front wall
17 Rear wall
18, 19 Channels
20, 21 Openings
22 to 25 Recesses
26 to 42 Gaps
43, 44 Electronic units
45 Operating capacitor
46 Evaporation tray
47 Evaporation grid
48 Water stop unit
48*a* Plug-in element
49 Snap connection
50 Plug-in connection
50*a*, 50*b* Plug-in elements
51, 51*a*, 51*b*, 51*c* Snap elements
52 Catch element
53 Plug-in connection
53*a*, 53*b* Plug-in elements
54, 55 Support ribs
56 Openings
57 Box
57*a* Locking element
57*b* Element
58 Opening
59 Locking connection

The invention claimed is:

1. A domestic refrigeration appliance comprising a housing, in which an inner container which delimits an inner chamber for holding food is arranged, and comprising a machine chamber, which is separate from the inner chamber and in which at least components of a refrigeration circuit of the domestic refrigeration appliance are arranged, wherein a carrier tray is arranged in the machine chamber, the carrier tray including a base and longitudinal side walls having channels that are C-shaped in cross-section, on which said carrier tray at least one further part supported by the carrier tray is held in a connecting manner by a fastening assembly having at least one of at least one snap connection, at least one plug-in connection, and at least one locking connection, said fastening assembly not including additional fastening elements, wherein the at least one further part is supported by the C-shaped channels of the longitudinal side walls, the at least one fastening assembly configured to engage with the C-shaped channels of the longitudinal walls to fix a position of the at least one further part.

2. The domestic refrigeration appliance as claimed in claim 1, wherein the fastening assembly includes the at least one locking connection, and the at least one locking connection includes at least one locking mount in the base that is configured for locking connection.

3. The domestic refrigeration appliance as claimed in claim 1, wherein the at least one further part is connected to the carrier tray at two separate points at least.

4. The domestic refrigeration appliance as claimed in claim 1, wherein the fastening assembly includes the at least one plug-in connection and the at least one locking connection, wherein a first part of the at least one further part is fastened to the base of the carrier tray with the at least one locking connection, and to a longitudinal side wall of the carrier tray with the at least one plug-in connection.

5. The domestic refrigeration appliance as claimed in claim 4, wherein the first part of the at least one further part, when connected to the carrier tray, has a dimension in a direction perpendicular to a longitudinal axis of the carrier tray that is smaller than a distance between two longitudinal side walls of the carrier tray.

6. The domestic refrigeration appliance as claimed in claim 4, wherein the first part of the at least one further part is an operating capacitor housing of the domestic refrigeration appliance.

7. The domestic refrigeration appliance as claimed in claim 1, wherein the fastening assembly includes the at least one plug-in connection and the at least one snap connection, wherein a part of the at least one further part is fastened to a first longitudinal side wall of the carrier tray with the at least one snap connection, and is connected to a second longitudinal side wall of the carrier tray with the at least one plug-in connection.

8. The domestic refrigeration appliance as claimed in claim 1, wherein the fastening assembly includes the at least one snap connection, and the appliance further comprises a part of the at least one further part, the part of the at least one further part being connected to the carrier tray by the at least one snap connection, the snap connection having a pivotable snap element which engages in one of the channels on an upper edge face of one of the longitudinal side wall of the carrier tray.

9. The domestic refrigeration appliance as claimed in claim 8, wherein the pivotable snap element has at least one integral plug-in element for a plug-in connection.

10. The domestic refrigeration appliance as claimed in claim 7, wherein the part of the at least one further part is a water stop unit or a collection and evaporation tray for thawed water or an electronic unit or a refrigerant compressor of a refrigeration circuit of the domestic refrigeration appliance.

11. The domestic refrigeration appliance as claimed in claim 1, wherein the fastening assembly includes the at least one plug-in connection, the at least one plug-in connection having plug-in elements in the form of projecting ribs formed on the at least one further part.

12. The domestic refrigeration appliance as claimed in claim 1, wherein the fastening assembly includes the at least one snap connection, and wherein the at least one further part includes the at least one snap connection, the at least one snap connection interacting with at least one of the longitudinal side walls to support the at least one further part.

13. The domestic refrigeration appliance as claimed in claim 1, wherein the at least one further part is arranged at a distance from the base such that the at least one further part does not contact the base of the carrier tray.

14. The domestic refrigeration appliance as claimed in claim 1, wherein the at least one further part is configured to slide along the channels, and then the fastening assembly locks with a part of at least one of the channels.

15. A domestic refrigeration appliance comprising a housing, in which an inner container which delimits an inner chamber for holding food is arranged, and comprising a machine chamber, which is separate from the inner chamber and in which at least components of a refrigeration circuit of the domestic refrigeration appliance are arranged, wherein a carrier tray is arranged in the machine chamber, on which said carrier tray at least one further part supported by the carrier tray is held in a connecting manner by at least one snap connection and at least one plug-in connection, wherein the carrier tray includes a base and longitudinal side walls that extend parallel to an X axis and are spaced from each other along a perpendicular Z axis, and having a height along a Y axis, the longitudinal side walls having channels that are C-shaped in cross section on upper edge faces of the longitudinal side walls, the upper edge faces including gaps for receiving said at least one plug-in in at least one of said channels, the at least one snap connection including at least one snap element provided to the further part, the at least one snap element configured to engage with at least one of the C-shaped channels and fixing a vertical position along the Y axis of the at least one further part in which the further part is spaced from the base during and upon assembly.

16. The domestic refrigeration appliance as claimed in claim 15, wherein said channels extend longitudinally over an entire length of the longitudinal side walls.

17. The domestic refrigeration appliance as claimed in claim 15, wherein the channels include a first channel on a first side of the tray and a second channel on an opposite second side of the tray.

18. The domestic refrigeration appliance as claimed in claim 17, wherein the first channel includes a first opening and the second channel includes a second opening, the first opening and the second opening facing each other.

19. The domestic refrigeration appliance as claimed in claim 15, wherein the at least one further part includes the at least one plug-in connection that is placed within one of the gaps in said channels.

20. The domestic refrigeration appliance as claimed in claim 15, wherein the at least one plug-in connection extends through an upper surface of a C-shaped channel of the channels, and abuts a lower surface of the C-shaped channel.

21. The domestic refrigeration appliance as claimed in claim 15, wherein the at least one further part includes the at least one plug-in connection that restricts longitudinal movement and the at least one further part includes the at least one connection that restricts vertical movement.

22. The domestic refrigeration appliance as claimed in claim 15, wherein said at least one further part is configured to slide along the channels until the at least one plug-in connection reaches one of the gaps, at which point the at least one snap element snaps to the respective channel and fixes the at least one part to the carrier tray.

23. The domestic refrigeration appliance as claimed in claim 15, wherein the at least one further part is configured to be inserted into only one of the channels, and is then pivoted to fix the further part to the carrier tray via the at lease one snap connection.

* * * * *